US008701312B2

(12) United States Patent
Wagger et al.

(10) Patent No.: US 8,701,312 B2
(45) **Date of Patent: *Apr. 22, 2014**

(54) HITCH DEVICE FOR CONNECTING A GROOMER VEHICLE AND A SKI SLOPE SNOW GROOMING IMPLEMENT, AND CONTROL METHOD EMPLOYING SUCH A HITCH DEVICE

(71) Applicant: Rolic Invest S.AR.L, Luxembourg (LU)

(72) Inventors: Klaus Wagger, Brunico (IT); Jan Muller, Vipiteno (IT)

(73) Assignee: Snowgrolic S.AR.L., Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 13/794,129

(22) Filed: Mar. 11, 2013

(65) Prior Publication Data

US 2013/0185963 A1 Jul. 25, 2013

Related U.S. Application Data

(63) Continuation of application No. 12/740,951, filed as application No. PCT/EP2008/064693 on Oct. 29, 2008, now Pat. No. 8,413,353.

(30) Foreign Application Priority Data

Oct. 30, 2007 (IT) ..... MI2007A002096

(51) Int. Cl.
*E01H 4/00* (2006.01)

(52) U.S. Cl.
USPC ..... 37/223

(58) Field of Classification Search
USPC ..... 37/219, 223, 236, 245, 247, 234, 220, 37/222; 172/72, 112, 123
See application file for complete search history.

(56) References Cited

U.S. PATENT DOCUMENTS 3,170,533 A 2/1965 Fewel et al.
3,227,295 A 1/1966 Hamilton et al.

(Continued)

FOREIGN PATENT DOCUMENTS

CA 2211050 1/1998
CA 2443765 A1 4/2004

(Continued)

OTHER PUBLICATIONS

PistenBully 600 brochure, written by Kassbohrer Gelandefahrzeug AG, published in Mar. 2010.

(Continued)

*Primary Examiner* — Robert Pezzuto
(74) *Attorney, Agent, or Firm* — Neal, Gerber & Eisenberg LLP

(57) ABSTRACT

A hitch device for connecting a groomer vehicle having a first frame extending along a first axis, and an implement, in particular a rotary snow tiller, for grooming the snow covering of ski slopes and having a second frame extending crosswise to and symmetrically with respect to a second axis. The hitch device has an arm hinged to the first frame about a third axis perpendicular to the first axis, and about a fourth axis perpendicular to the first and third axis; a first actuator for adjusting the position of the arm about the third axis with respect to the first frame to lift and lower the implement; at least one second actuator for adjusting the position of the arm about the fourth axis with respect to the first frame; a movable coupling movable between the arm and one of the first and second frame; and a third actuator for adjusting the position of the arm in a plane crosswise to the fourth axis.

42 Claims, 4 Drawing Sheets

(56) References Cited

U.S. PATENT DOCUMENTS

| | | | |
|---|---|---|---|
| 3,386,778 | A | 6/1968 | Rymes |
| 3,534,701 | A | 10/1970 | Hebert |
| 3,692,132 | A | 9/1972 | Pollanen |
| 3,763,944 | A | 10/1973 | Kaltenegger |
| 4,087,135 | A | 5/1978 | Unruh |
| 4,348,825 | A | 9/1982 | Bachler |
| 4,458,954 | A | 7/1984 | Haas |
| 4,458,955 | A | 7/1984 | Webb |
| 4,500,139 | A | 2/1985 | Tucek |
| 4,788,783 | A | 12/1988 | Bachler |
| 5,062,493 | A | 11/1991 | Platter et al. |
| 5,067,263 | A | 11/1991 | Pelletier |
| 6,155,363 | A | 12/2000 | Matsumoto et al. |
| 6,296,330 | B1 | 10/2001 | Hall |
| 6,354,023 | B1 | 3/2002 | Trahan et al. |
| 6,418,645 | B1 | 7/2002 | Hammerle et al. |
| 6,637,134 | B2 | 10/2003 | Hammerle |
| 6,810,609 | B2 | 11/2004 | Lassonde et al. |
| 6,921,304 | B2 | 7/2005 | Hewitt |
| 6,983,927 | B2 | 1/2006 | Pelletier et al. |
| 7,464,699 | B2 | 12/2008 | Joppig et al. |
| 7,530,547 | B2 | 5/2009 | Leitner et al. |
| 2002/0139013 | A1 | 10/2002 | Hammerle |
| 2003/0051376 | A1 | 3/2003 | Lassonde et al. |
| 2003/0159840 | A1 | 8/2003 | Schmidt, Jr. |
| 2004/0069981 | A1 | 4/2004 | Pelletier et al. |
| 2005/0252592 | A1 | 11/2005 | Albright et al. |
| 2005/0279980 | A1 | 12/2005 | Leitner et al. |
| 2007/0130806 | A1 | 6/2007 | Goodman |
| 2008/0257616 | A1 | 10/2008 | Olsson |
| 2008/0269986 | A1 | 10/2008 | Regnell et al. |
| 2008/0309157 | A1 | 12/2008 | Runggaldier et al. |
| 2009/0000833 | A1 | 1/2009 | Dorais et al. |
| 2009/0007461 | A1 | 1/2009 | Pelletier et al. |
| 2009/0013562 | A1 | 1/2009 | Pelletier |

FOREIGN PATENT DOCUMENTS

| | | | |
|---|---|---|---|
| CN | 2584664 | | 11/2003 |
| CN | 2795280 | | 7/2006 |
| DE | 2145772 | | 3/1973 |
| DE | 2148304 | | 4/1973 |
| DE | 2219623 | | 11/1973 |
| DE | 2254276 | | 5/1974 |
| DE | 3440491 | | 5/1986 |
| DE | 3534626 | | 3/1987 |
| DE | 29515866 | | 1/1996 |
| DE | 29603251 | | 4/1996 |
| DE | 10320523 | | 11/2004 |
| EP | 0551160 | | 7/1993 |
| EP | 1405782 | | 4/2004 |
| EP | 1674382 | A1 | 10/2005 |
| EP | 1591350 | A2 | 11/2005 |
| EP | 1827954 | B1 | 12/2005 |
| EP | 1995159 | A1 | 6/2007 |
| EP | 1872683 | A1 | 1/2008 |
| EP | 1908673 | B1 | 9/2009 |
| EP | 1908672 BI | | 4/2010 |
| FR | 2336292 | | 7/1977 |
| FR | 2536437 | | 5/1984 |
| FR | 2586727 | | 3/1987 |
| GB | 1590358 | | 6/1981 |
| JP | 01144287 | | 10/1989 |
| JP | 03182887 | | 8/1991 |
| JP | 7237566 | | 9/1995 |
| WO | WO2005093173 | | 10/2005 |
| WO | WO2006069671 | | 7/2006 |
| WO | WO2006069682 | | 7/2006 |
| WO | WO2008114138 | | 9/2008 |
| WO | WO2008155423 | | 12/2008 |
| WO | WO2008155425 | | 12/2008 |
| WO | WO2009034183 | | 3/2009 |
| WO | WO2009034185 | | 3/2009 |
| WO | WO2009056576 | | 5/2009 |
| WO | WO2009056578 | | 5/2009 |
| WO | WO2009056579 | | 5/2009 |

OTHER PUBLICATIONS

PistenBully Scout brochure, written by Kassbohrer Gelandefahrzeug AG, published in Jan. 2010.

First Office Action for Chinese Application No. 200880117801.9, mailed Oct. 18, 2011 (10 pages).

Response to First Office Action for Chinese Application No. 200880117801.9 (3 pages).

HITCH DEVICE FOR CONNECTING A GROOMER VEHICLE AND A SKI SLOPE SNOW GROOMING IMPLEMENT, AND CONTROL METHOD EMPLOYING SUCH A HITCH DEVICE

PRIORITY CLAIM

This application is a continuation of, claims the benefit of and priority to U.S. patent application Ser. No. 12/740,951, filed on Aug. 13, 2010 which is a national stage application of PCT/EP2008/064693, filed on Oct. 29, 2008, which claims the benefit of and priority to Italian Patent Application No. MI2007A 002096, filed on Oct. 30, 2007, the entire contents of which are incorporated by reference herein.

TECHNICAL FIELD

The present disclosure relates to a hitch device for connecting a groomer vehicle and a ski slope snow grooming implement.

BACKGROUND

Known groomer vehicles are normally powered crawler vehicles comprising a frame extending along a first axis; and a snow grooming implement which is normally a rotary snow tiller drawn by the groomer vehicle and comprising a second frame extending predominantly crosswise to and symmetrically with respect to a second axis which, when traveling along a straight path, is aligned with the first axis, and, when traveling along a curved path, forms an angle with the first axis.

Such known hitch devices comprise an arm or so-called boom hinged to the first frame about a third axis perpendicular to the first axis, and about a fourth axis perpendicular to the first and third axis; a first actuator is connected to the first frame and the arm to adjust the position of the arm about the third axis with respect to the first frame; and at least one second actuator is connected to the first frame and the arm to adjust the position of the arm about the fourth axis.

The first actuator is often a hydraulic cylinder for lifting and lowering the arm to selectively lift and lower the rotary snow tiller with respect to the snow covering. The second actuator sets the angle between the first and second axis: when traveling along a straight path, the second actuator keeps the arm aligned with the first and second axis; and, when traveling along a curved path, the second actuator sets the arm to form a given angle with the first axis about the fourth axis.

Known hitch devices have proved highly effective, both in lifting and lowering the rotary snow tiller, and as regards maneuvering around bends and stabilizing the position of the tiller.

In some ski slope grooming conditions, however, it is necessary for the rotary snow tiller to go over an already groomed strip of the snow covering without the groomer vehicle traveling over it.

Known hitch devices allow this to be done, but force the rotary snow tiller to operate in a skew position with respect to the traveling direction, which increases energy consumption and reduces grooming width.

Moreover, when traveling along a curved path, known hitch devices are not always able to position the rotary snow tiller to cover the prints left by the groomer vehicle in the snow covering.

SUMMARY

It is an object of the present disclosure to provide a hitch device for connecting a groomer vehicle and a ski slope snow grooming implement, configured to eliminate certain of the drawbacks of the above-described known groomer vehicles.

According to the present disclosure, there is provided a hitch device for connecting a groomer vehicle comprising a first frame extending along a first axis, and an implement, in particular a rotary snow tiller, for grooming the snow covering of ski slopes and comprising a second frame extending crosswise to and symmetrically with respect to a second axis; the hitch device comprising an arm hinged to the first frame about a third axis perpendicular to the first axis, and about a fourth axis perpendicular to the first and third axis; a first actuator for adjusting the position of the arm about the third axis with respect to the first frame to lift and lower the implement; and at least one second actuator for adjusting the position of the arm about the fourth axis with respect to the first frame; and the hitch device being characterized by comprising a movable coupling movable between the arm and one of the first and second frame; and a third actuator for adjusting the position of the arm in a plane perpendicular to the fourth axis.

The present disclosure also relates to a control method.

According to the present disclosure, there is provided a method of controlling a hitch device for connecting a groomer vehicle comprising a first frame extending along a first axis, and an implement, in particular a rotary snow tiller, for grooming the snow covering of ski slopes and comprising a second frame extending crosswise to and symmetrically with respect to a second axis; the hitch device comprising an arm hinged to the first frame about a third axis perpendicular to the first axis, and about a fourth axis perpendicular to the first and third axis; the method comprising adjusting the position of the arm about the third axis with respect to the first frame to lift and lower the implement; and adjusting the position of the arm about the fourth axis with respect to the first frame; and the method being characterized by further adjusting the position of the arm in a plane perpendicular to the fourth axis; the arm being connected to one of the first and second frame by a movable coupling.

Additional features and advantages are described in, and will be apparent from, the following Detailed Description and the figures.

BRIEF DESCRIPTION OF THE DRAWINGS

A number of non-limiting embodiments of the present disclosure will be described by way of example with reference to the accompanying drawings, in which.

DETAILED DESCRIPTION

Figure 1:
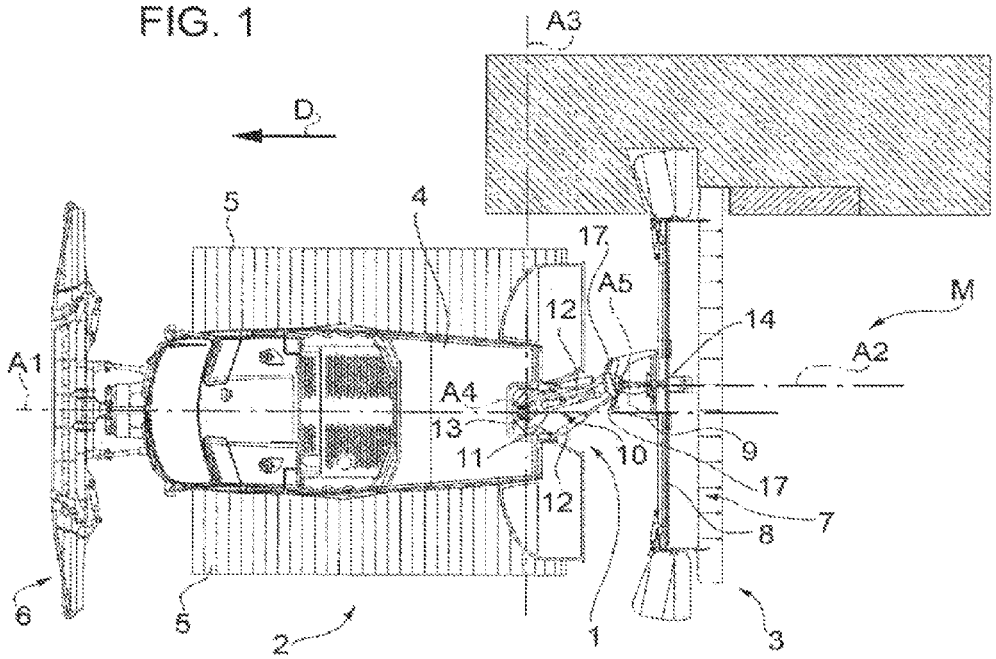
FIG. 1 shows a plan view, with parts removed for clarity, of a groomer vehicle connected to a snow grooming implement by a hitch device in accordance with the present disclosure and in a first operating position.
Figure 2:
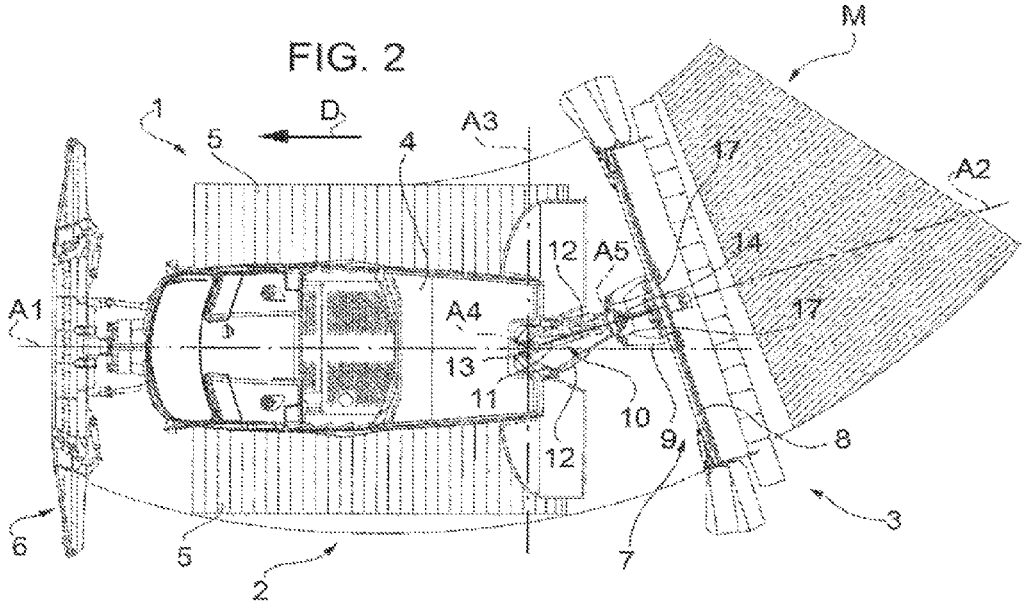
FIG. 2 shows a plan view, with parts removed for clarity, of the FIG. 1 groomer vehicle, snow grooming implement, and hitch device in a second operating position.

Referring now to the example embodiments of the present disclosure illustrated in FIGS. 1 to 5, number 1 in FIGS. 1 and 2 indicates as a whole a hitch device for connecting a groomer vehicle 2 and an implement 3, such as a rotary snow tiller, for grooming the snow covering M of ski slopes. Groomer vehicle 2 is powered and tows implement 3 along the ski slope, while the hitch device provides for controlling implement 3 according to the conditions imposed by the type of tilling operation to be performed.

Groomer vehicle 1 comprises a frame 4 extending predominantly along a central axis A1, two tracks 5 parallel to axis A1, and a shovel 6 connected to the front of frame 4, and is connected to implement 3 by hitch device 1, in turn connected to frame 4.

Implement 3 has a central axis A2, extends crosswise to the central axis A2, and comprises a frame 7, in turn comprising a bar 8 perpendicular to axis A2, and an arc-shaped bracket 9 connected rigidly to bar 8, located at the centreline of implement 3, and facing groomer vehicle 2.

Figure 3:
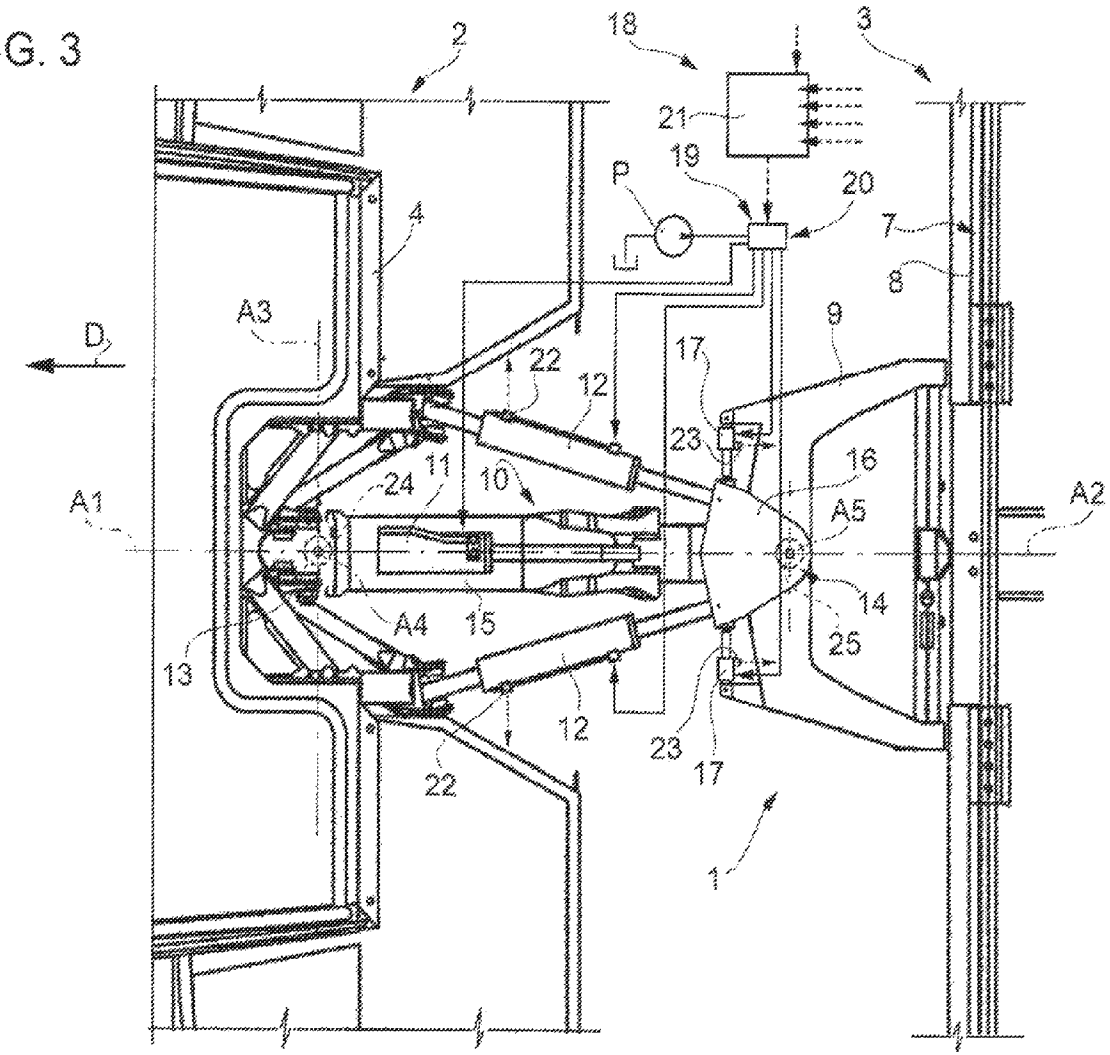
FIG. 3 shows a schematic, larger-scale plan view, with parts removed for clarity, of the FIG. 1 hitch device in a third operating position.

With reference to FIG. 3, hitch device 1 is connected to frame 4 and frame 7 at respective central axes A1 and A2, and comprises an arm 10 hinged to frame 4 about an axis A3; and an actuator 11, such as a hydraulic cylinder, connected to frame 4 and to arm 10 to rotate arm 10 about axis A3 to selectively lift and lower arm 10 and implement 3 with respect to snow covering M.

Arm 10 is hinged to frame 4 about an axis A4 perpendicular to axes A1 and A3, and comprises two actuators 12, such as two hydraulic cylinders, each connected to frame 4 and to arm 10 to control rotation of arm 10 about axis A4. Actuators 12 are located symmetrically on opposite sides of arm 10.

Hitch device 1 comprises a universal joint 13 between arm 10 and frame 4 to permit rotation about axes A3 and A4; and arm 10 is hinged to frame 7, such as by a hinge 14, about an axis A5 parallel to axis A4.

More specifically, arm 10 comprises a straight bar 15; and a plate 16 connected rigidly to one end of bar 15. Universal joint 13 is located at the opposite end of bar 15 to plate 16, and hinge 14 is located along plate 16.

Actuator 11 is located over bar 15 and hinged to frame 4 and bar 15; and each actuator 12 is located alongside bar 15 and hinged to frame 4 and plate 16.

Hitch device 1 comprises two actuators 17, each hinged to arm 10 and frame 7 to control rotation of frame 7 about axis A5 with respect to arm 10. In the example shown, actuators 17 connect bracket 9 to plate 16, and are symmetrical with respect to axis A2.

Hitch device 1 comprises a control device 18, in turn comprising a hydraulic circuit 19 connected to actuators 11, 12, 17 and equipped with an assembly 20 of valves to selectively supply actuators 11, 12, 17 along hoses (not shown); a control unit 21; linear sensors 22 associated with actuators 12; and linear sensors 23 associated with actuators 17.

Hydraulic circuit 19 comprises a pump P on board groomer vehicle 2 to pressure-Feed circuit 19.

Control unit 21 receives target signals indicating the desired position of frame 7 with respect to frame 4 (i.e., the desired position of actuators 12 and 17), and actual-position signals, indicating the actual position of actuators 12 and 17, from linear sensors 22 and 23, and supplies valve assembly 20 with regulation signals calculated by control unit 21 according to the difference between the target signals and the actual-position signals.

With reference to FIG. 1, in actual use, groomer vehicle 2 advances and tows implement 3 in a traveling direction D. It should be appreciated that when traveling along a straight path, axes A1 and A2 are aligned, and arm 10 is parallel to axes A1 and A2, as shown in FIG. 3.

When traveling along a curved path, as shown in FIG. 2, axes A1 and A2 form an angle of other than 180°, and arm 10 is inclined with respect to frame 4 by an angle determined by actuators 12, in some cases, to cover the prints left by tracks 5 of groomer vehicle 2, it is necessary to rotate frame 7 with respect to arm 10 by actuators 17. When traveling along a curved path, the steering curve of grooming vehicle 2 is transmitted to control unit 21 which calculates the position of actuators 12 and 17 accordingly, so implement 3 can groom the portion of snow covering M on which prints have been left by tracks 5, as shown in FIG. 2.

Control unit 21 also provides for setting given offset values between axes A1 and A2, (i.e., advancing groomer vehicle 2 and implement 3 along a straight path), with axes A1 and A2 offset and parallel, as in the operating position shown in FIG. 1. The distance between axes A1 and A2 is set by a given rotation about axis A4, and by the same amount of rotation in the opposite direction about axis A5.

In each of the FIGS. 1 to 3, positioning of implement 3 with respect to groomer vehicle 2 is achieved and maintained by control unit 21, which compares the signals from sensors 22 and 23 with the target signals, and emits regulation signals when the sensor signals deviate from the target signals.

In one alternative embodiment, linear sensors 22 and 23 are eliminated, and control device 18 comprises two angle sensors 24 and 25 (shown by dash lines in FIG. 3) for respectively determining the angle between arm 10 and frame 4 about axis A4, and the angle between arm 10 and frame 7 about axis A5.

Figure 4:
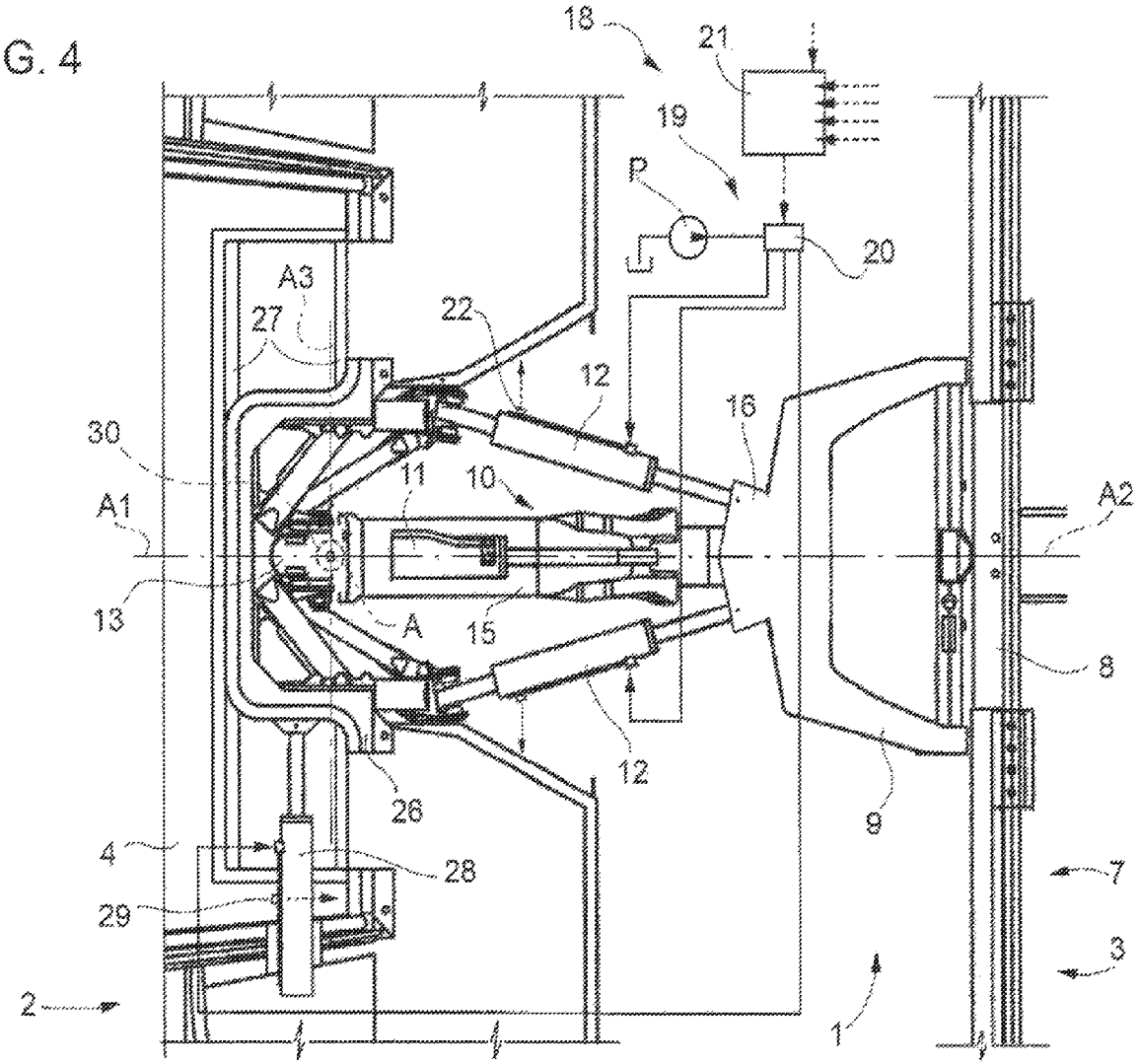
FIG. 4 shows a schematic plan view, with parts removed for clarity, of a hitch device in accordance with another embodiment of the present disclosure.

In the FIG. 4 embodiment, hitch device 1 comprises a slide 26 mounted to slide along a runner 27 parallel to axis A3; and an actuator 28 for selectively moving slide 26 along runner 27. Arm 10 is fixed rigidly to frame 7 in a position parallel to and aligned with axis A2, and is hinged about axes A3 and A4 with respect to slide 26. In this embodiment, actuators 12 are connected directly to slide 26 and arm 10, while actuators 17 are eliminated.

In addition to linear sensors 22 of respective actuators 12, control device 18 comprises a linear sensor 29 associated with actuator 28, while linear sensors 23 are eliminated.

In another embodiment, linear sensors 22 are replaced by an angle sensor 30 shown by a dash line in FIG. 4.

This embodiment operates in the same way as described above when traveling along a straight path, on which arm 10 is kept aligned with axes A1 and A2, and in fact cannot move with respect to axis A2. Axes A2 and A1 are offset by actuator 28 translating the whole of slide 26 along runner 27 by an amount equal to the desired amount of offset.

When traveling along a curved path, the position of implement 3 with respect to groomer vehicle 2, and of axis A2 with respect to axis A1, is achieved by rotating arm 10 about axis A4 and translating slide 26 with respect to frame 4.

Figure 5:
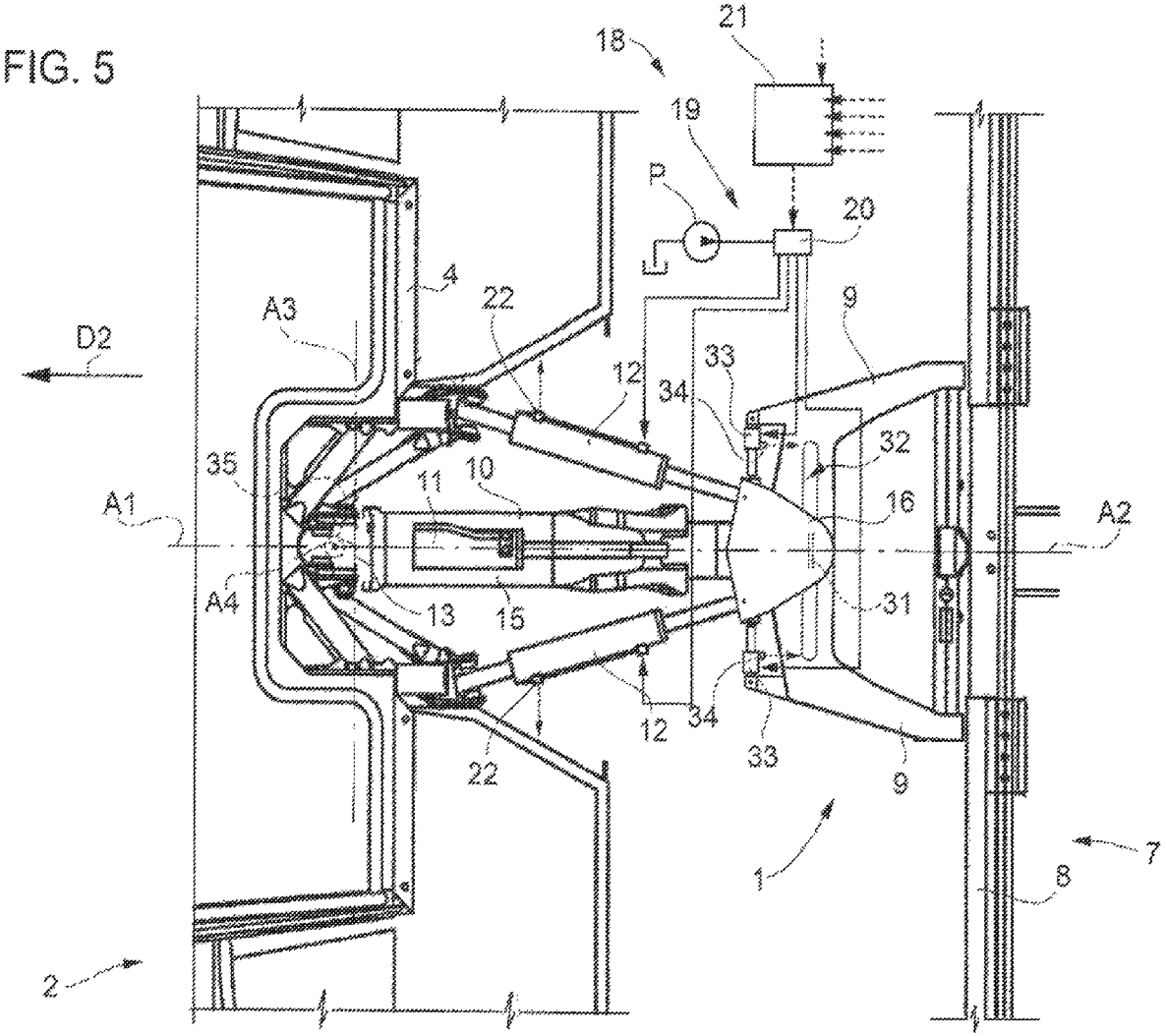
FIG. 5 shows a schematic plan view, with parts removed for clarity, of a hitch device in accordance with another embodiment of the present disclosure.

In the FIG. 5 embodiment, hitch device 1 is connected directly to frame 4 by universal joint 13, and is connected to frame 7 to slide in a direction perpendicular to axes A2 and A4. Plate 16 is integral with a slide 31 mounted to slide along a runner 32 of bracket 9 of frame 7. In this embodiment, hitch device 1 comprises two actuators 33 connected to frame 7 and slide 31 to selectively set slide 31 to a given position with respect to frame 7.

In addition to linear sensors 22 of respective actuators 12, control device 18 comprises two linear sensors 34, each associated with a respective actuator 33.

Instead of linear sensors 22, in one embodiment, control device 18 may comprise an angle sensor 35 shown by a dash line in FIG. 5.

This embodiment operates in the same way as described above, except that translation takes place between arm 10 and frame 7 as opposed to between arm 10 and frame 4.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A snow groomer hitch device configured to connect a snow groomer vehicle including a first frame extending along a first axis to a snow grooming implement including a second frame extending crosswise to a different, second axis, the snow groomer hitch device comprising:

an arm hingable to the snow groomer vehicle, wherein when hinged to the snow groomer vehicle: (i) said arm is configured to lift and lower the snow grooming implement about a different, third axis, and (ii) the arm is coupled to the first frame and to the second frame to enable displacing, with two degrees of freedom, the snow groomer implement with respect to the snow groomer vehicle in a plane where the third axis lies.

2. The snow groomer hitch device of claim 1, wherein, when hinged to the snow groomer vehicle, the arm is coupled to one of: the first frame and the second frame, to shift the second axis with respect to the first axis along said plane.

3. The snow groomer hitch device of claim 1, wherein, when hinged to the snow groomer vehicle, the arm is coupled to one of: the first frame and the snow groomer implement, to incline the second axis with respect to the first axis.

4. The snow groomer hitch device of claim 1, wherein the two degrees of freedom include: (i) a rotation about a fourth axis, and (ii) a rotation about a fifth axis, wherein the fourth axis and the fifth axis are parallel to each other and to said plane.

5. The snow groomer hitch device of claim 1, wherein the two degrees of freedom include: (i) a rotation about a fourth axis, and (ii) a translation between the arm and the first frame.

6. The snow groomer hitch device of claim 1, wherein the two degrees of freedom include: (i) a rotation about a fourth axis, and (ii) a translation between the arm and second frame.

7. The snow groomer hitch device of claim 1, including an actuator connected to the arm, wherein when the arm is hinged to the snow groomer vehicle, the actuator is configured to: (i) adjust a position of the arm about the third axis with respect to the first frame to lift the snow grooming implement, and (ii) adjust the position of the arm about the third axis with respect to the first frame to lower the snow grooming implement.

8. The snow groomer hitch device of claim 1, wherein the arm is hingable to the first frame about a fourth axis and which includes at least one actuator configured to, when the arm is hinged to the first frame, adjust the position of the arm about the fourth axis with respect to the first frame.

9. The snow groomer hitch device of claim 1, wherein the arm is hingable to the second frame about a fourth axis and which includes an actuator configured to, when the arm is hinged to the second frame, adjust the position of the second frame with respect to the arm.

10. The snow groomer hitch device of claim 1, wherein the arm is configured to be slideably coupled to the first frame in a direction parallel to the third axis and which includes an actuator configured to, when the arm is slideably coupled to the first frame, displace the arm with respect to the first frame in the direction parallel to the third axis.

11. The snow groomer hitch device of claim 1, wherein the arm is configured to be slideably coupled to the second frame in said plane and perpendicularly to the second axis, and which includes an actuator configured to, when the arm is slideably coupled to the second frame, displace the second frame with respect to the arm in said plane and perpendicularly to the second axis.

12. A snow groomer assembly comprising:

a snow groomer vehicle including a first frame extending along a first axis;

a snow groomer implement including a second frame extending crosswise to a second axis; and a hitch device connecting the snow groomer implement to the snow groomer vehicle, said hitch device including an arm hinged to the snow groomer vehicle and configured to lift and lower the snow grooming implement about a third axis, said arm being coupled to the snow groomer vehicle and to the snow groomer implement to enable displacing, with two degrees of freedom, the second frame with respect to the first frame in a plane where the third axis lies.

13. The snow groomer assembly of claim 12, wherein the arm is coupled to at least one of: the first frame snow groomer vehicle and the snow groomer implement, to shift the second axis with respect to the first axis along said plane.

14. The snow groomer assembly of claim 12, wherein the arm is coupled to one of: the snow groomer vehicle and the snow groomer implement, to incline the second axis with respect to the first axis.

15. The snow groomer assembly of claim 12, wherein the two degrees of freedom include: (i) a rotation about a fourth axis, and (ii) a rotation about a fifth axis, wherein the fourth axis and the fifth axis are parallel to each other and to said plane.

16. The snow groomer assembly of claim 12, wherein the two degrees of freedom include: (i) a rotation about a fourth axis, and (ii) a translation between the arm and the snow groomer vehicle.

17. The snow groomer assembly of claim 12, wherein the two degrees of freedom include: (i) a rotation about a fifth axis, and (ii) a translation between the arm and the snow groomer implement.

18. The snow groomer assembly of claim 12, which includes a control device configured to control a position of the second frame with respect to the first frame.

19. The snow groomer assembly of claim 18, wherein:

the hitch device includes a plurality of actuators connected to the arm and, the control device includes a hydraulic circuit connected to the plurality of actuators and an assembly of valves to selectively supply the plurality of actuators.

20. The snow groomer assembly of claim 18, wherein:

the hitch device includes a plurality of actuators connected to the arm and the control device includes a control unit and a plurality of sensors associated with the plurality of actuators.

21. The snow groomer assembly of claim 20, wherein the control unit is configured to:

store a plurality of target signals indicating the desired position of the second frame with respect to the first frame, acquire a plurality of actual-position signals, and calculate a plurality of regulation signals according to the difference between the plurality of target signals and the plurality of actual-position signals.

22. A snow groomer hitch device configured to connect a snow groomer vehicle including a first frame extending along a first axis to a snow grooming implement including a second frame extending crosswise to a different, second axis, the snow groomer hitch device comprising:

an arm hingable to the snow groomer vehicle wherein, when hinged to the snow groomer vehicle: (i) said arm is configured to lift and lower the snow grooming implement about a different, third axis, and (ii) the arm is coupled to the first frame and to the second frame to enable the snow groomer implement to: (a) move in a first direction with respect to the snow groomer vehicle in a plane where the third axis lies, and (b) move in a second, different direction with respect to the snow groomer vehicle in the plane where the third axis lies.

23. The snow groomer hitch device of claim 22, wherein, when hinged to the snow groomer vehicle, the arm is coupled to one of: the first frame and to the second frame, to shift the second axis with respect to the first axis along said plane.

24. The snow groomer hitch device of claim 22, wherein, when hinged to the snow groomer vehicle, the arm is coupled to one of: the first frame and the snow groomer implement, to incline the second axis with respect to the first axis.

25. The snow groomer hitch device of claim 22, wherein the two directions of movement include: (i) a rotation about a fourth axis, and (ii) a rotation about a fifth axis, wherein the fourth and the fifth axis are parallel to each other and to said plane.

26. The snow groomer hitch device of claim 22, wherein the two directions of movement include: (i) a rotation about a fourth axis, and (ii) a translation between the arm and the first frame.

27. The snow groomer hitch device of claim 22, wherein the two directions of movement include: (i) a rotation about a fourth axis, and (ii) a translation between the arm and second frame.

28. The snow groomer hitch device of claim 22, including an actuator connected to the arm, wherein when the arm is hinged to the snow groomer vehicle, the actuator is configured to: (i) adjust a position of the arm about the third axis with respect to the first frame to lift the snow grooming implement, and (ii) adjust the position of the arm about the third axis with respect to the first frame to lower the snow grooming implement.

29. The snow groomer hitch device of claim 22, wherein the arm is hingable to the first frame about a fourth axis and which includes at least one actuator configured to, when the arm is hinged to the first frame, adjust the position of the arm about the fourth axis with respect to the first frame.

30. The snow groomer hitch device of claim 22, wherein the arm is hingable to the second frame about a fourth axis and which includes an actuator configured to, when the arm is hinged to the second frame, adjust the position of the second frame with respect to the arm.

31. The snow groomer hitch device of claim 22, wherein the arm is configured to be slideably coupled to the first frame in a direction parallel to the third axis and which includes an actuator configured to, when the arm is slideably coupled to the first frame, displace the arm with respect to the first frame in the direction parallel to the third axis.

32. The snow groomer hitch device of claim 22, wherein the arm is configured to be slideably coupled to the second frame in said plane and perpendicularly to the second axis, and which includes an actuator configured to, when the arm is slideably coupled to the second frame, displace the second frame with respect to the arm in said plane and perpendicularly to the second axis.

33. A snow groomer assembly comprising:

a snow groomer vehicle including a first frame extending along a first axis;

a snow groomer implement including a second frame extending crosswise to a second axis; and a hitch device connecting the snow groomer implement to the snow groomer vehicle, said hitch device including an arm hinged to the snow groomer vehicle and configured to lift and lower the snow grooming implement about a third axis, said arm being coupled to the snow groomer vehicle and to the snow groomer implement to enable the snow groomer implement to: (a) move, in a first direction, the second frame with respect to the first frame in a plane where the third axis lies, and (b) move, in a different, second direction, the second frame with respect to the first frame in the plane where the third axis lies.

34. The snow groomer assembly of claim 33, wherein the arm is coupled to at least one of: the first frame snow groomer vehicle and the snow groomer implement, to shift the second axis with respect to the first axis along said plane.

35. The snow groomer assembly of claim 33, wherein the arm is coupled to one of: the snow groomer vehicle and the snow groomer implement, to incline the second axis with respect to the first axis.

36. The snow groomer assembly of claim 33, wherein the two directions of movement include: (i) a rotation about a fourth axis, and (ii) a rotation about a fifth axis, wherein the fourth axis and the fifth axis are parallel to each other and to said plane.

37. The snow groomer assembly of claim 33, wherein the two directions of movement include: (i) a rotation about a fourth axis, and (ii) a translation between the arm and the snow groomer vehicle.

38. The snow groomer assembly of claim 33, wherein the two directions of movement include: (i) a rotation about a fifth axis, and (ii) a translation between the arm and the snow groomer implement.

39. The snow groomer assembly of claim 33, which includes a control device configured to control a position of the second frame with respect to the first frame.

40. The snow groomer assembly of claim 39, wherein:

the hitch device includes a plurality of actuators connected to the arm and, the control device includes a hydraulic circuit connected to the plurality of actuators and an assembly of valves to selectively supply the plurality of actuators.

41. The snow groomer assembly of claim 39, wherein:

the hitch device includes a plurality of actuators connected to the arm and the control device includes a control unit and a plurality of sensors associated with the plurality of actuators.

42. The snow groomer assembly of claim 41, wherein the control unit is configured to:

store a plurality of target signals indicating the desired position of the second frame with respect to the first frame, acquire a plurality of actual-position signals, and calculate a plurality of regulation signals according to the difference between the plurality of target signals and the plurality of actual-position signals.

* * * * *